US008834813B2

(12) United States Patent
Park et al.

(10) Patent No.: US 8,834,813 B2
(45) Date of Patent: Sep. 16, 2014

(54) CHIP FOR ANALYZING FLUIDS

(75) Inventors: Jun Ha Park, Seoul (KR); Chan Il Chung, Seoul (KR); Jun Keun Chang, Seoul (KR); Dae Sung Hur, Gyeonggi-do (KR); Ji Young Park, Seoul (KR)

(73) Assignee: Nanoentek, Inc., Seoul (KR)

( * ) Notice: Subject to any disclaimer, the term of this patent is extended or adjusted under 35 U.S.C. 154(b) by 482 days.

(21) Appl. No.: 12/729,583

(22) Filed: Mar. 23, 2010

(65) Prior Publication Data

US 2011/0036152 A1 Feb. 17, 2011

Related U.S. Application Data

(63) Continuation-in-part of application No. 12/667,371, filed as application No. PCT/KR2008/004314 on Jul. 23, 2008.

(30) Foreign Application Priority Data

Jul. 23, 2007 (KR) ..... 10-2007-0073659

(51) Int. Cl.
*B01L 99/00* (2010.01)
*B01L 3/00* (2006.01)

(52) U.S. Cl.
CPC ..... *B01L 3/5027* (2013.01); *B01L 2400/0406* (2013.01); *B01L 2300/0858* (2013.01); *B01L 23/0816* (2013.01); *B01L 2300/0851* (2013.01); *B01L 2400/086* (2013.01)
USPC ..... 422/507; 422/503

(58) Field of Classification Search
CPC ..... B01L 3/5027
USPC ..... 422/502–504, 507
See application file for complete search history.

(56) References Cited

U.S. PATENT DOCUMENTS

| | | | | |
|---|---|---|---|---|
| 7,169,353 | B1 * | 1/2007 | Colin et al. | 422/412 |
| 2003/0138969 | A1 * | 7/2003 | Jakobsen et al. | 436/180 |
| 2005/0244838 | A1 * | 11/2005 | Wojtowicz | 435/6 |
| 2006/0246533 | A1 * | 11/2006 | Fathollahi et al. | 435/23 |

FOREIGN PATENT DOCUMENTS

| | | | |
|---|---|---|---|
| JP | 03-223674 | | 10/1991 |
| JP | 2002-538482 | | 11/2002 |
| WO | 2005/062059 | A1 | 7/2005 |
| WO | 2007/040313 | A1 | 4/2007 |

OTHER PUBLICATIONS

International Search Report from PCT/KR2008/004314, Mailing Date of Dec. 30, 2008.
Japanese Office Action and English-language translation for Japanese Patent Application No. 2010-514650.

* cited by examiner

*Primary Examiner* — Paul Hyun
(74) *Attorney, Agent, or Firm* — Sherr & Jiang, PLLC

(57) ABSTRACT

A fluid analysis chip includes a channel formed within the chip. The chip includes a sample inlet and a sample outlet communicating with an outside of the chip, where the sample inlet and the sample outlet communicate with each other through the closed channel. An expanding part of the channel is formed in a longitudinal direction of the channel in such a manner that a pair of inner walls of the channel define an inner surface of the expanding part, and the expanding part has a larger sectional area than the channel.

17 Claims, 10 Drawing Sheets

*-Prior Art-*

*-Prior Art-*

*-Prior Art-*

CHIP FOR ANALYZING FLUIDS

CROSS-REFERENCES TO RELATED APPLICATIONS

This application is a continuation-in-part application of U.S. application Ser. No. 12/667,371 filed on Dec. 30, 2009, which is a U.S. national phase application, pursuant to 35 U.S.C. §371, of PCT/KR2008/004314, filed Jul. 23, 2008, designating the United States, which claims priority to Korean Application No. 10-2007-0073659, filed on Jul. 23, 2007. The entire contents of the aforementioned patent applications are incorporated herein by this reference.

TECHNICAL FIELD

The present invention relates to a chip having a microchannel, through which fluids moves, and more particularly to a chip for analyzing sample fluids, which includes a sample inlet and a sample outlet, and has a structure where the sample inlet and the sample outlet communicate with each other through a closed channel with a pipe shape.

BACKGROUND ART

In general, biological, chemical, and/or optical analysis of sample fluids is used in analyzing blood clinically collected from a patient and diagnosing diseases, as well as a chemical field and a biotechnology field. Various kinds of chip structures have been developed and used so as to provide an analyzing and/or diagnosing apparatus, which has a further smaller size, and performs analysis of sample fluid in more effective manner. As such, the object of development of a lab-on-a-chip is to make it possible for various functions to be performed in one chip so as to increase effectiveness in analysis and/or diagnosis of diseases, and to make it possible to manufacture a rapid kit.

A lab-on-a-chip means implementing various test processes, which are performed in a laboratory, for example, the separation, refinement, mixing, labeling, analysis, and washing, etc. of a sample, on a chip having a small size. Techniques related to microfluidics and a micro-LHS are typically used in designing the lab-on-a-chip. Also, in manufacturing a chip-structure implementing microfluidics and the micro-LHS, a chip, in which a microchannel is formed at the interior of the chip by using a semiconductor circuit designing technique, has been put on the market.

In general, detecting and analyzing analytes in a very small amount, which are included in sample fluid, such as blood, a body fluid, urine, etc., includes analyzing if a sample fluid reacts against proteins, such as antigens, antibodies, etc. or other material, which have been previously immobilized on a chip, while moving through a channel having a pipe-shaped structure formed in the interior of the chip, through detection of fluorescent material, etc. Therefore, a technique for observing movement of fluids moving in a chip having a channel through the channel and a technique for manufacturing a channel structure are the most important core techniques in manufacturing a small-sized chip for performing fluid analysis and obtaining accurate analysis result by using such a chip.

In a chip (or a structure) having a microchannel implementing microfluidics, in order to allow fluids to flow through an inner space formed by a microchannel, a small-size motor is used, or a method for limiting the width and height of a channel so as to allow fluids to move through a microchannel due to capillary phenomenon is used. At this time, in a chip where main driving force causing movement of fluids is capillary force, the result of investigation shows that fact that fluids flowing in a space formed by a channel have an irregular and nonuniform movement pattern. It is understood that such a phenomenon occurs because acting force due to relative action between upper and lower inner walls of a channel and fluids is different from acting force due to relative action between left and lower inner walls of the channel and fluids. As a result, such a nonuniform movement pattern of fluids has been a big obstacle to detection and analysis of analytes in a very small amount in the fluids.

Meanwhile, a chip, which has a sample inlet and a sample outlet included at both ends thereof and has a structure where fluids injected into the sample inlet is discharged through the sample outlet through a closed channel shaped similar to a pipe, is manufactured in such a manner that upper and lower substrates are manufactured and are assembled with each other. However, in order to manufacture a microchannel structure having a size below several tens of micrometers, it is difficult to process edge parts of a channel without loss of other part thereof, and it is also difficult to control standards and quality of a product in mass production. Also, the fine difference of such a channel structure obstructs uniform flux of fluids so that it causes a sample analysis result without consistency in a chip used in detecting analytes in an extremely small amount from a small amount of a sample.

For example, a chip shown in FIGS. 1 and 2 is one example of a conventional chip. The chip includes a body 10 formed in such a manner that a first substrate 11 and a second substrate 12 are assembled with each other. A channel recess 13*b* having a predetermined width and depth is formed at the first substrate 11. In order to form a space to be filled with a sample, the channel recess 13*b* is formed at the first substrate 11 in such a manner that it extends in a longitudinal direction of the substrate while having a predetermined width and a predetermined depth. Therefore, when the first substrate 11 and the second substrate 12 are assembled with each other, the channel 13 has an airtight space. Also, a sample inlet 14, which extends to the outside of the channel so as to allow a sample to be injected into the channel 13, is formed at one end of the channel 13, and a sample outlet 15, which extends to the outside of the channel so as to allow the sample to be discharged, is formed at the other end of the channel. When sample fluid to be analyzed is injected into the channel 13, the injected sample fluid moves along the channel 13 toward the sample outlet 15. As shown in FIG. 3, when the sample fluid forms a pattern while moving, a difference of relative actions between the fluid, which passes though the channel, and upper, lower, left, and right inner walls 13*a* of the channel can cause a difference of capillary force, which is main driving force of movement of fluid in the microchannel. As a result, irregular pattern where a pattern is firstly formed along the left and right inner walls 13*a* is generated. Accordingly, many bubbles are generated in the fluid, thereby causing many problems in analyzing the sample fluid.

In a chip having a channel, which has a space for allowing fluids to flow and also has a sample inlet formed at one side of the channel and a sample outlet formed at the other side thereof, the inventors manufactured a chip having an expanding part, which has a sectional area larger than sectional areas of the left and right inner walls of the channel, formed at entire or a part of each left and right inner wall, and analyzed a pattern of movement of fluids. As a result, the inventors confirmed that the shape of movement of the fluids passing through the channel has a very regular and uniform pattern in the chip according to the present invention so that they completed the present invention.

In addition, the inventors made an ideal form of a speed profile of fluids passing through the inner channel by having a chamfering part on a bottom part of the inner walls at both sides of the channel, and formed a washing part which can accept fluids except for a specimen fixed on the channel on the end of the channel to decrease unnecessary noise to complete the present invention.

The above information disclosed in this Background Art section is only for enhancement of understanding of the background of the invention and therefore it may contain information that does not form the prior art that is already known in this country to a person of ordinary skill in the art.

SUMMARY OF THE DISCLOSURE

Therefore, the present invention has been made in view of the above-mentioned problems, and it is an object of the present invention to provide a fluid analysis chip, which includes a sample inlet and a sample outlet which extend to outside of the chip and has a structure where the sample inlet and the sample outlet communicate with each other through a closed channel shaped like a pipe, wherein fluid flows through the channel moves while having a regular and uniform pattern.

Also, the present invention provides a method for manufacturing a fluid analysis chip.

Also, the present invention provides a sample fluid analysis method using the fluid analysis chip.

Additionally, the present invention provides the fluid analysis chip which makes an ideal speed profile of the fluid passing through the inner channel as well as improves reliability of the fluid analysis by decreasing unnecessary noise except for the specimen fixed on the channel.

According to an aspect of the present invention, there is provided a In accordance with an aspect of the present invention, there is provided a chip including a sample inlet and a sample outlet communicating with the outside of the chip, this chip having a structure where the sample inlet and the sample outlet communicate with each other through a closed channel, wherein an expanding part is formed in a longitudinal direction of the channel in such a manner that a pair of inner walls corresponding to each other has a larger sectional area at a part or the whole thereof, so that fluid, which passes through the channel adjacent to the expanding part, moves while making contact with only another pair of inner walls of the channel, which correspond to each other. As such, in the fluid analysis chip according to the present invention, left and right inner walls of the closed channel are substantially expanded so that fluid passing through the channel can move while making contact with only upper and lower inner walls of the channel. As a result, relative action regarding movement of fluid depends on the upper and lower inner walls of the channel so that it is possible to obtain the uniform movement pattern of fluids.

Also, in manufacturing the fluid analysis chip according to the present invention, expanding recesses are formed at each entire part or each part of the left and right inner wall, respectively, in such a manner that they have a sectional area larger than a sectional area of each side inner wall of the channel. Since this doesn't need an accurate process of forming an edge of the channel, the fluid analysis chip is suitable for mass production.

As described above, a fluid analysis chip according to the present invention includes an expanded recess having an inner space, which has an expanded shape, and communicates with a channel. Therefore, a regular movement pattern of fluid passing through the channel is formed so that generation of bubbles is reduced, recurrence is secured, and it is easily performed to detect a signal from analytes in fluids. Also, in implementing a microchannel in a substrate, it is possible to manufacture the channel without concern of loss of each edge of the channel or deformation thereof. Therefore, it is easy to achieve mass production and quality control.

Additionally, the fluid analysis chip according to the present invention makes the ideal speed profile of the fluid passing through the inner channel as well as improves reliability of the fluid analysis by decreasing unnecessary noise except for the specimen fixed on the channel.

The above features and advantages of the present invention will be apparent from or are set forth in more detail in the accompanying drawings, which are incorporated in and form a part of this specification, and the following Detailed Description, which together serve to explain by way of example the principles of the present invention.

BRIEF DESCRIPTION OF DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
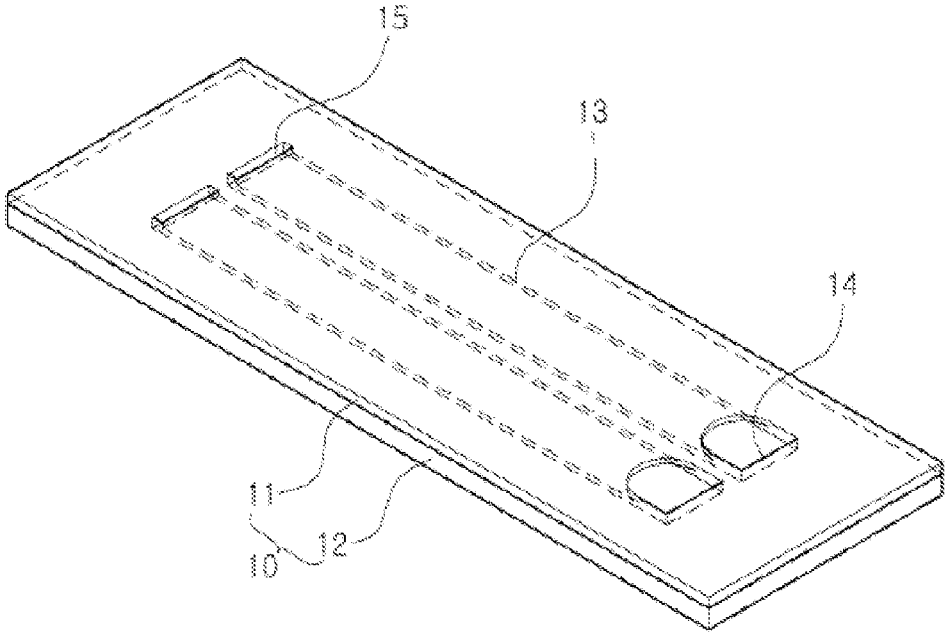
FIG. 1 is a perspective view illustrating a conventional structure of a chip.
Figure 2:
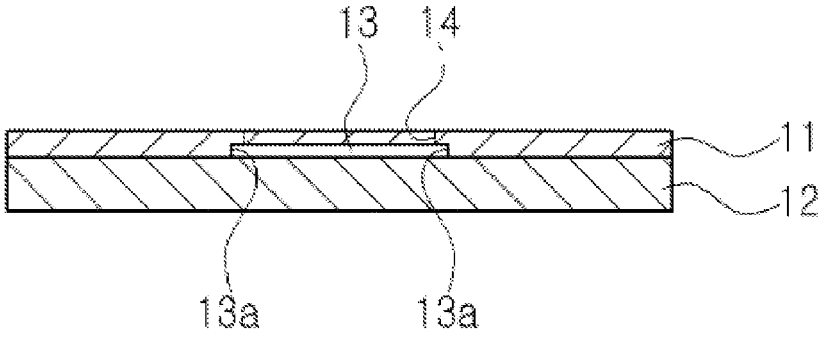
FIG. 2 is a sectional view of the chip shown in FIG. 1.
Figure 3:
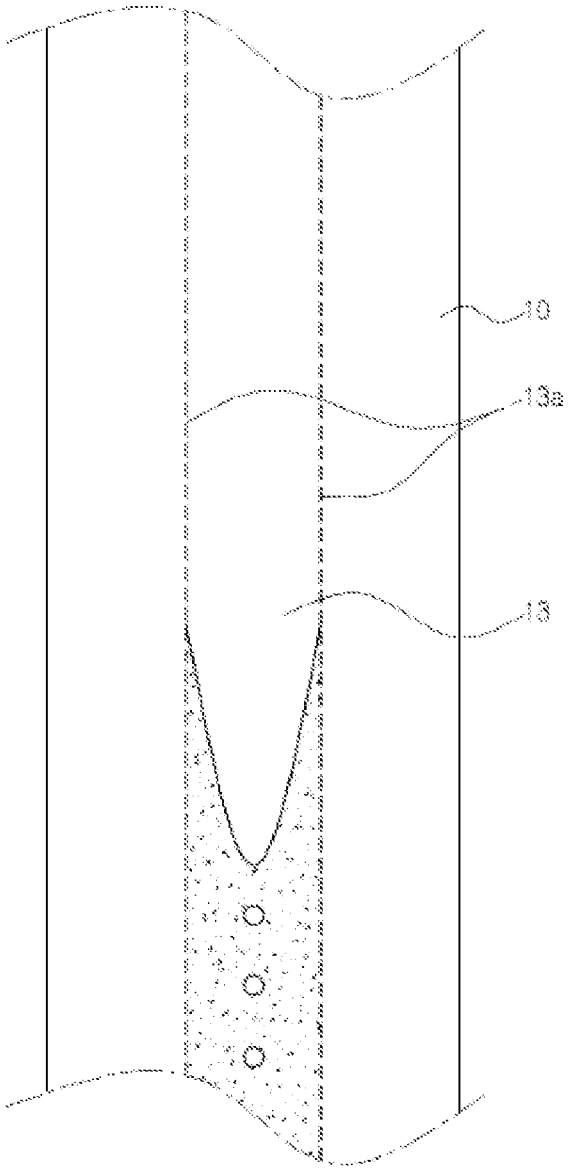
FIG. 3 is a plane view of the chip shown in FIG. 1.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF EMBODIMENTS

Hereinafter, fluid analysis chips according to embodiments of the present invention will be described in detail with reference to the accompanying drawings. In description of the fluid analysis chips according to the present invention, structures and parts equal to them of a conventional chip designated by the same reference, and are described in detail with reference to FIG. 1.

As a term used in the present invention, "closed channel" means a channel which is formed at an interior of a chip so that fluids can flow through the channel without exposure to outside of the chip, and has a shape similar to a pipe.

As a term used in the present invention, "channel inner wall" means each surface of a channel, which limits a space allowing fluids flow therein.

Figure 4:
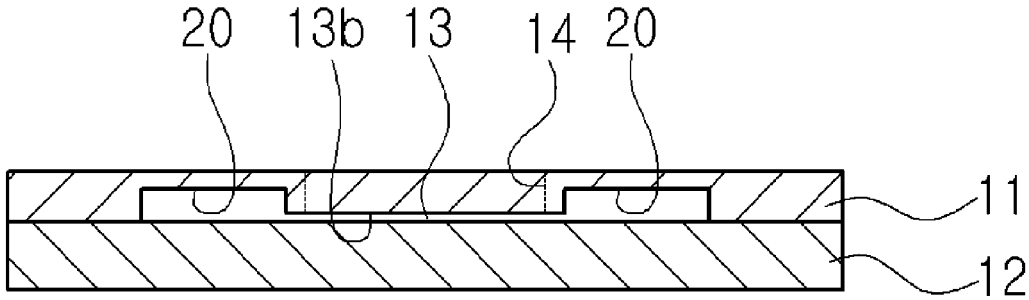
FIG. 4 is a sectional view of a fluid analysis chip according to a first embodiment of the present invention.
Figure 5:
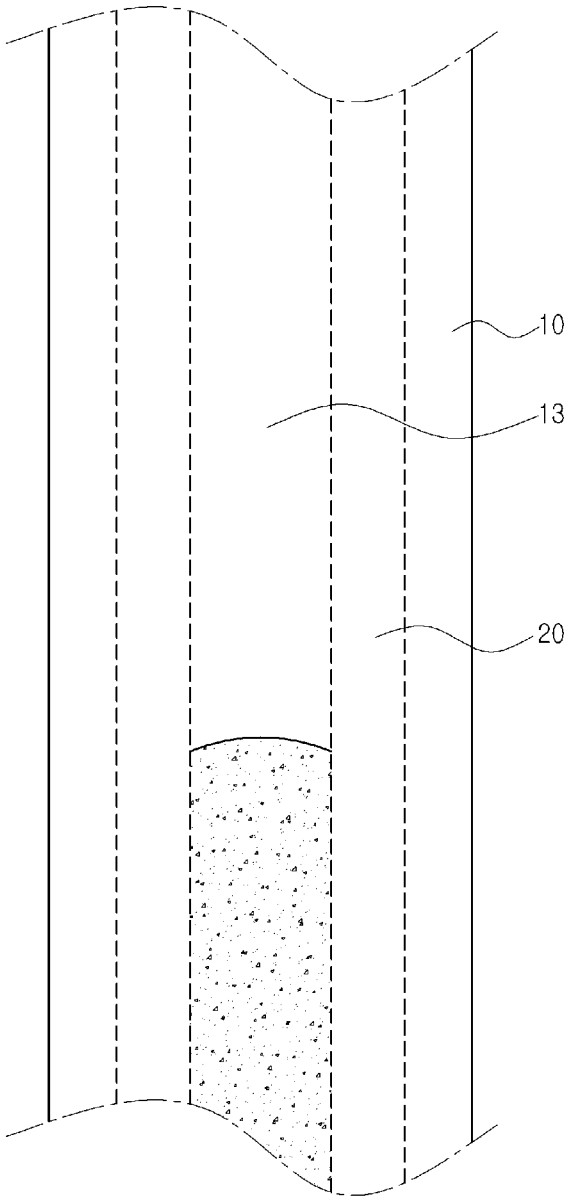
FIG. 5 is a plane view of the fluid analysis chip shown in FIG. 4 according to the present invention, in which a movement pattern of fluids flowing in the chip is shown.

FIG. 4 is a sectional view of a fluid analysis chip according to a first embodiment of the present invention, and FIG. 5 is a plane view of the fluid analysis chip.

As shown, the fluid analysis chip according to the first embodiment of the present invention has a main body 10 formed in such a manner that a first substrate 11 and a second substrate 12 are assembled with each other. A channel recess 13*b* is formed at the first substrate 11 with a predetermined depth and a predetermined length, and extends in a longitudinal direction of the first substrate so as to form a space to be filled with simple fluids. Therefore, the channel 13 has an airtight space when the first substrate 11 and the second substrate 12 are assembled with each other, and a sample inlet 14 and a sample outlet 15 are formed at both ends of the channel 13, respectively.

Also, expanding recesses 20 are formed on the first substrate along left and right inner walls of the channel 13, respectively, while having each depth deeper than a depth of the channel 13, and extend along the left and right inner walls of the channel 13 in a longitudinal direction of the channel. When the first substrate is assembled with the second substrate 12, expanding parts as an expanding space communicating with both sides of a space formed by the channel 13 are formed.

In the fluid analysis chip according to the first embodiment of the present invention, as shown in FIG. 5, when sample fluid including analytes is injected into the channel 13, the injected sample fluid moves toward the outlet 150 along the channel 13 and the expanding recesses 20 while making contact with the upper and lower inner walls of the channel so that a pattern is formed. At this time, relative action between the sample fluid and both side walls of the channel 13 decreases due to the expanding recesses 20 so that a uniform pattern of movement of the sample fluid is formed. Therefore, generation of bubbles decreases, recurrence is secured, and it is easily performed to detect signals from analytes.

Figure 6:
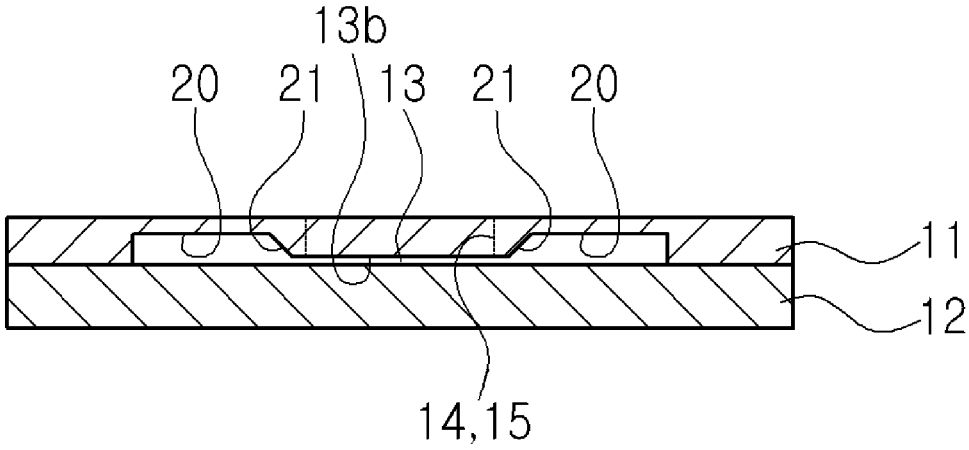
FIG. 6 is a sectional view of a fluid analysis chip according to a second embodiment of the present invention.

The second embodiment of the present invention is shown in FIG. 6. A fluid analysis chip according to the second embodiment includes a main body 10, which is formed in such a manner that a first substrate 11 and a second substrate 12 are assembled with each other. A channel recess 13*b* is formed at the first substrate 11 with a predetermined depth and a predetermined length, and extends in a longitudinal direction of first substrate so as to form a space to be filled with sample fluids. The channel 13 has an airtight space when the first substrate 11 and the second substrate 12 are assembled with each other, and a sample inlet 14 and a sample outlet 15 are formed at both ends of the channel 13, respectively. Also, as shown in FIG. 6, among both inner surfaces of each expanding recess, an inner surface bent toward the channel 13 is a slanting surface 21 having a depth becoming shallower toward the channel 13. The remaining structure and a formed sample pattern are equal to the first embodiment of the present invention.

Figure 7:
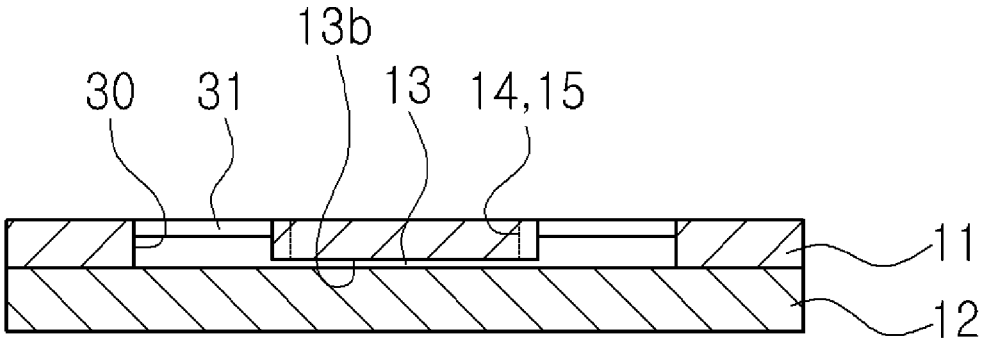
FIG. 7 is a sectional view of a fluid analysis chip according to a third embodiment of the present invention.

FIG. 7 illustrates a third embodiment of the present invention. A fluid analysis chip according to the third embodiment of the present invention includes a main body 10, which is formed in such a manner that a first substrate 11 and a second substrate 12 are assembled with each other. A channel recess 13*b* is formed at the first substrate 11 with a predetermined depth and a predetermined length, and extends in a longitudinal direction of first substrate so as to form a space to be filled with sample fluids. The channel 13 has an airtight space when the first substrate 11 and the second substrate 12 are assembled with each other, and a sample inlet 14 and a sample outlet 15 are formed at both ends of the channel 13, respectively. As shown in FIG. 7, expanding holes 30, which extend through the first substrate 1 along both boundary surfaces of the channel 13, respectively, are formed at the first substrate 1 so as to form an expanding part. Each expanding hole 30 extends along both inner surfaces of the channel 13, and preferably has connecting parts 31 formed with each interval so as to prevent a product from breaking. The remaining structure and formed sample pattern are equal to the first embodiment.

Figure 8:
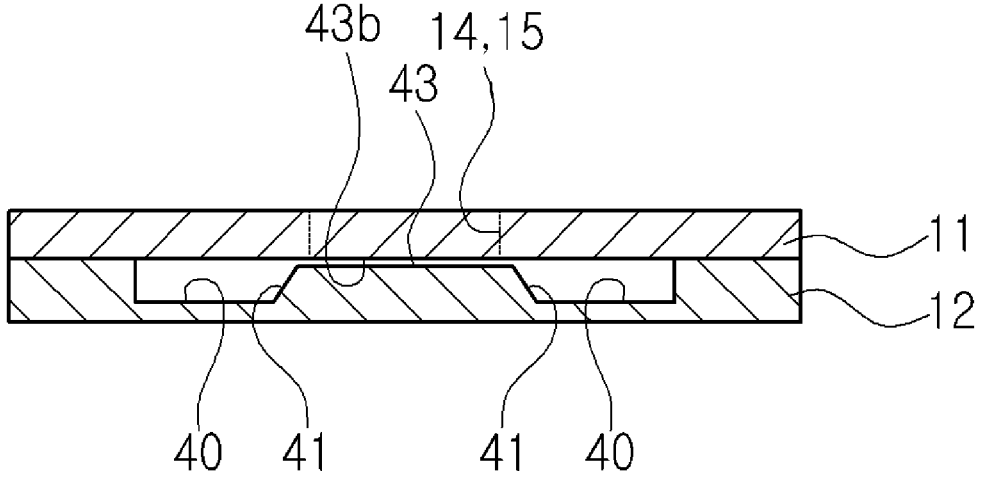
FIG. 8 is a sectional view of a fluid analysis chip according to a fourth embodiment of the present invention.

FIG. 8 illustrates a fourth embodiment of the present invention. A fluid analysis chip according to the fourth embodiment of the present invention includes a main body 10 formed in such a manner that a first substrate 11 and a second substrate 12 are assembled with each other. A channel recess 13*b* is formed at the first substrate 11 with a predetermined depth and a predetermined length and extends in a longitudinal direction of first substrate so as to form a space to be filled with sample fluids. The channel 13 has an airtight space when the first substrate 11 and the second substrate 12 are assembled with each other, and a sample inlet 14 and a sample outlet 15 are formed at both ends of the channel 13, respectively. Also, as shown in FIG. 8, among both inner surfaces of each expanding recess 40, an inner surface bent toward the channel 43 is a slanting surface 41 having a depth shallower toward the channel 43.

As such, the fluid analysis chip according to the present invention includes the expanding recesses 20 and 40, which are spaces expanding along both left and right inner surfaces, and or the expanding holes 30. Therefore, when sample fluid is injected in the channel and moves due to the expanding recesses 20 and 40 the expanding holes 30, relative action between the left and right inner walls of the channel 13 and 43 and the sample fluid disappears or decreases so that the movement pattern of the sample fluid is uniformly formed along surfaces of the channel 13 and 43. Therefore, generation of bubbles in the fluid decreases, recurrence is secured, and it is possible to easily detect signals from analytes in the fluid.

The characteristic of each structure of the expanding recesses 20 and 40 and the expanding hole 30 makes it possible to prevent flatness of the channel 13 and 43 from decreasing due to contraction when the fluid analysis chip according to the present invention is formed by injection.

Moreover, any embodiment of the present invention can be manufactured in such a manner that at least two channel communicate, which sample inlets different from each other and sample outlets different from each other, respectively, are included in one chip. Also, it is possible to manufacture a fluid analysis chip having a structure where one sample inlet and one sample outlet communicate with each other through at least two channels.

Figure 9:
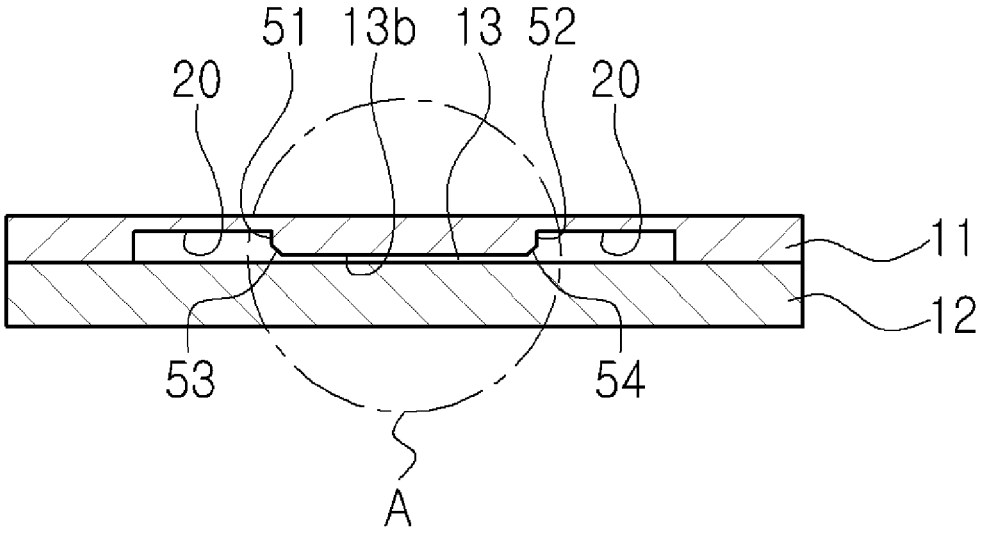
FIG. 9 is a sectional view of a fluid analysis chip according to a fifth embodiment of the present invention.

FIG. 9 illustrates a fifth embodiment of the present invention. A fluid analysis chip according to the fifth embodiment of the present invention includes a main body 10 formed in such a manner that a first substrate 11 and a second substrate 12 are assembled with each other. A channel recess 13*b* is formed at the first substrate 11 with a predetermined depth and a predetermined length and extends in a longitudinal direction of the first substrate so as to form a space to be filled with sample fluids. The channel 13 has an airtight space when the first substrate 11 and the second substrate 12 are assembled with each other, and a sample inlet 14 and a sample outlet 15 are formed at both ends of the channel 13, respectively. Meanwhile, as shown in FIG. 9, a pair of chamfering parts (53, 54) are included in a longitudinal direction of both sides of the inner walls (51, 52) of the expanding recesses (50).

Figure 10:
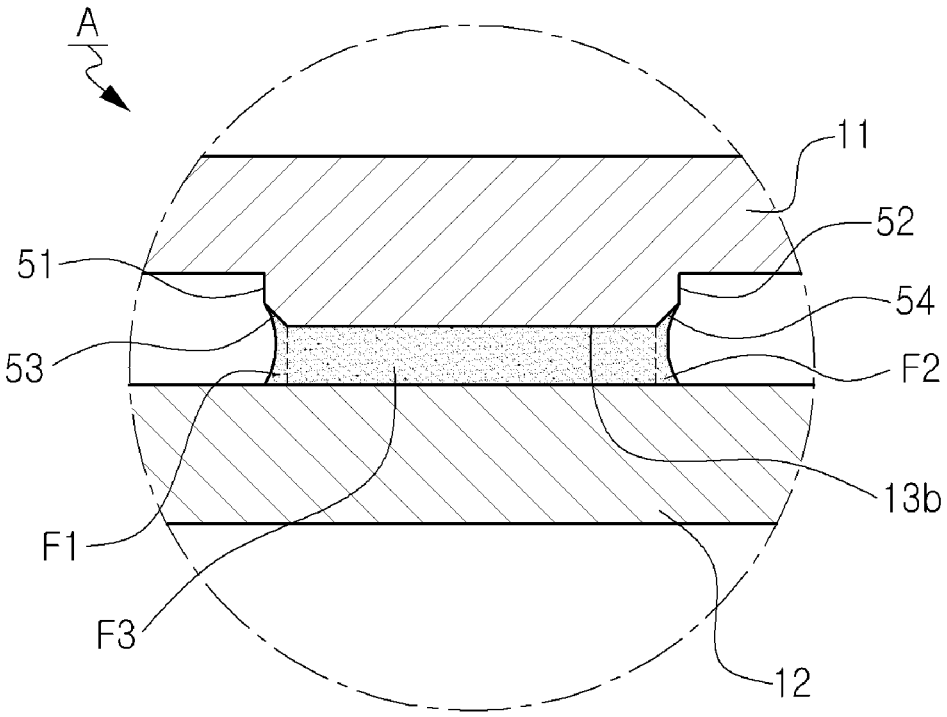
FIG. 10 is a sectional view of an interface of a fluid formed according to a chamfering part of FIG. 9.

The chamfering parts (53, 54) are included by chamfering the bottom part of both sides of the inner walls (51, 52) of the channel (13) in a longitudinal direction of the channel (13). The chamfering parts (53, 54) allow the fluid to flow stably and maintain the ideal profile form, by forming an interface of the fluid which flows according to the channel (13) as illustrated in FIG. 10. That is, since a flow rate of fluids (F1, F2) adjacent to the chamfering parts (53, 54) is less than a flow rate of fluid (F3) which is not adjacent to the chamfering parts, a front head part of the fluid has a shape as illustrated in FIG. 5, and thus the fluid can stably flow along the channel (13). Meanwhile, unlike the embodiment according to the present invention, the chamfering parts (53, 54) can be included by chamfering only one side of the inner walls (51 or 52) of the channel (13) in a longitudinal direction of the channel (13), or can be intermittently, not consecutively, included by chamfering only one part of the inner walls (51, 52) of the channel (13) (not illustrated).

Meanwhile, a flow rate delay hole (11*a*) passing through the first substrate (11) is formed on one end of the channel (13) adjacent to a sample outlet (15) side. The flow rate delay hole (11*a*) prevents the fluids from being leaked to the outside of the channel (13) by delaying the flow rate of the fluid passing through the channel (13), and thus promotes a stable effect of the fluid flow.

The remaining structure and a formed sample pattern are equal to the first embodiment of the present invention.

Figure 11:
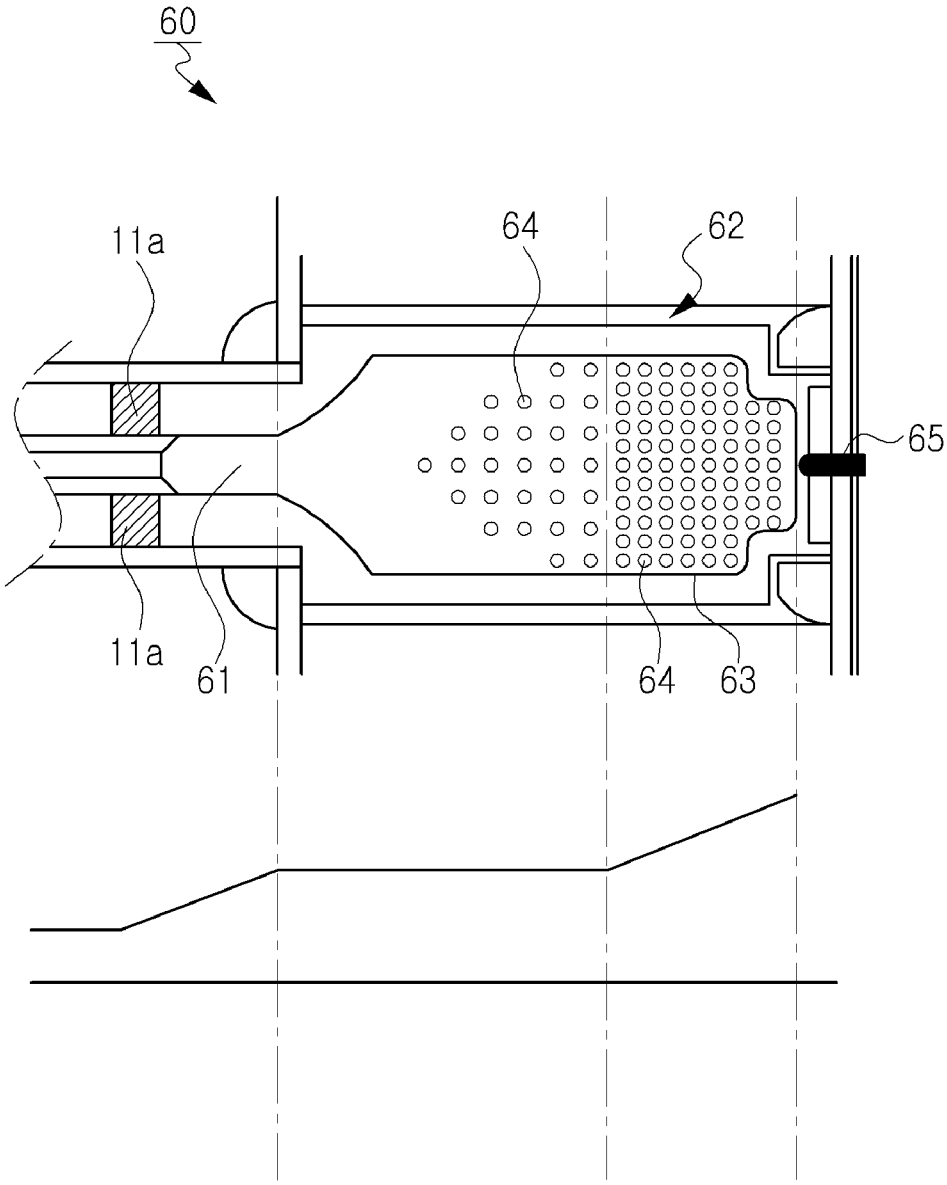
FIG. 11 is a plane view of a washing part of a fluid analysis chip according to a sixth embodiment of the present invention.

FIG. 11 illustrates a sixth embodiment of the present invention. A fluid analysis chip according to the sixth embodiment of the present invention includes a main body 10 formed in such a manner that a first substrate 11 and a second substrate 12 are assembled with each other. A channel recess 13*b* is formed at the first substrate 11 with a predetermined depth and a predetermined length and extends in a longitudinal direction of the first substrate so as to form a space to be filled with sample fluids. The channel 13 has an airtight space when the first substrate 11 and the second substrate 12 are assembled with each other, and a sample inlet 14 and a sample outlet 15 are formed at both ends of the channel 13, respectively. Meanwhile, as shown in FIG. 11, one end of the fluid analysis chip wherein the channel (13) ends include a washing part (60) which accepts the fluid passing through the channel (13).

The washing part (60) provides a space in which materials except for analytes fixed on the channel (13) can be accepted. The materials except for the analytes flowing along the channel (13) by the capillary force may be seen as a sort of noise which deteriorates the accuracy of an analysis. The washing part (60) can improve an analysis of the fluid analysis chip by providing the space which can accept this noise. The washing part (60) comprises a washing channel introduction (61) included in one end of the channel (13); a washing channel wherein the fluid passing through the channel (13) is accepted; a plurality of washing part pillars (64) included in the washing channel (62); and a washing part bent hole (65) formed at the end of the washing channel (62).

The washing channel introduction (61) interconnects one end of the channel (13) with the washing channel (62). As illustrated in the bottom drawing (a broad side sectional view of the washing part (60)) of FIG. 11, the washing channel introduction (61) is configured to have a gradual level difference so as to increase the distance between the first substrate (11) and the second substrate (12) moving towards the washing channel (62). Since the flow rate of the fluid flowing along the washing channel introduction (61) is gradually decreased, the fluid can stay in the channel (13) for a long time, and thus a sufficient reaction time for analytes in the fluid can be obtained. Additionally, as the washing channel introduction (61) slowly fills the fluid in the washing channel (62), it helps the fluid to flow in a stable form.

The washing channel (62) flows along the channel (13), and is configured to accept noise except for reacted analytes. The washing channel (62) is configured to have a larger volume than the washing channel introduction (61). Additionally, one end of the washing channel (62) includes a washing volume increasing part (63) configured to have a gradual level difference so as to increase the distance between the first substrate (11) and the second substrate (12). Since the reasons why the washing channel (62) has a larger volume than the washing channel introduction (61) and includes the washing volume increasing part (63) are the same as the reason why the washing channel introduction (61) is configured to have a gradual level difference, an overlapped explanation is omitted.

As the washing volume increasing part (63) accepts much more fluids, it helps to effectively remove the fluid wherein the materials except for the analytes are included.

As the washing part pillar (64) is formed for the most part of the washing channel (62), a plurality of the washing part pillars are included to be projected in a lower direction from a bottom surface of the first substrate (11). Also, the washing part pillar (64) is more densely formed moving to the end of the washing channel (62). This is to move the fluid sufficiently to the end of the washing channel (62) by the increase of the capillary force. That is, the fluid according to the present invention is only moved by the capillary force, and since this capillary force is weakened moving from one end (sample inlet (14) side) of the fluid analysis chip to the other end (sample outlet (15) side) of the fluid analysis chip, the washing part pillar (64) is included to complement this. The washing part pillar (64) strengthens the weakened capillary force by broadening the surface area which the fluid can reach.

The washing part bent hole (65) is formed by passing through the first substrate (11) in a center region in a width direction of the first substrate (11) from one end of the washing channel (62). The washing part bent hole (65) makes flows of a pressure and a gas inside the washing channel (62) so that the fluid can move to the washing part (60). Additionally, the washing part bent hole (65) is formed with a sufficient size not to be clogged when the first substrate (11) and the second substrate (12) are assembled to each other.

The remaining structure and a formed sample pattern are equal to the first embodiment of the present invention.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

The invention claimed is:

1. A fluid analysis chip comprising:

a sample inlet and a sample outlet communicating with an outside of the chip;

a channel; and an expanding part formed in a longitudinal direction of the channel in such a manner that a pair of inner walls of the channel define a pair of inner surfaces of the expanding part, and the expanding part has a larger sectional area than a remainder of the channel, wherein the sample inlet and the sample outlet communicate with each other through the channel, fluid passes through the channel adjacent to the expanding part, and the pair of inner walls of the channel are chamfered so as to maintain stable fluid flow through the channel.

2. The fluid analysis chip as claimed in claim 1, wherein the channel is formed in such a manner that a first substrate, which has a channel recess extending along a longitudinal direction of the channel while having a predetermined depth and a predetermined width, and a second substrate are assembled with each other, the sample inlet communicating with the channel recess is formed in the first substrate, and the expanding part includes an expanding recess having a depth deeper than a depth of the channel recess of the first substrate.

3. The fluid analysis chip as claimed in claim 1, wherein the channel is formed in such a manner that a first substrate and a second substrate, which has a channel recess extending along a longitudinal direction of the channel while having a predetermined width and a predetermined depth, are assembled with each other, the sample inlet communicating the channel recess is formed in the first substrate, and the expanding part includes an expanding recess having a depth deeper than a depth of the channel recess of the second substrate.

4. The fluid analysis chip as claimed in claim 1, wherein the channel is formed in such a manner that a first substrate, which has a channel recess extending along a longitudinal direction of the channel while having a predetermined depth and a predetermined width, and a second substrate are assembled with each other, the sample inlet communicating with the channel recess is formed in the first substrate, and the expanding part includes expanding holes formed along the channel recess.

5. The fluid analysis chip as claimed in claim 1, further including at least a second channel communicating with a second sample inlet and a sample outlet.

6. The fluid analysis chip as claimed in claim 1, wherein the sample inlet and the sample outlet communicate with each other through the channel and at least a second channel.

7. The fluid analysis chip as claimed in claim 2, wherein a flow rate delay hole is formed on one end of the channel adjacent to the sample outlet side by passing through the first substrate.

8. The fluid analysis chip as claimed in claim 7, further comprising a washing part in which the fluid passing through the channel is accepted, the washing part being formed on one end of the channel adjacent to the sample outlet side.

9. The fluid analysis chip as claimed in claim 8, wherein the washing part comprises:

a washing channel in which the fluid passing through the channel is accepted; and a washing channel introduction portion which interconnects one end of the channel adjacent to the washing channel with the washing channel.

10. The fluid analysis chip as claimed in claim 9, wherein the washing channel introduction portion is configured to have smaller volume than the washing channel.

11. The fluid analysis chip as claimed in claim 9, wherein the washing channel introduction portion is configured to have a gradual level difference corresponding to the distance between the first substrate and the second substrate, such that the gradual level difference increases moving towards the washing channel.

12. The fluid analysis chip as claimed in claim 9, wherein the washing channel includes a washing volume increasing part configured to have a gradual level difference corresponding to the distance between the first substrate and the second substrate, such that the gradual level difference increases toward one end of the washing channel.

13. The fluid analysis chip as claimed in claim 12, wherein the first substrate comprises a plurality of washing part pillars configured to be projected from a bottom surface.

14. The fluid analysis chip as claimed in claim 13, wherein the plurality of washing part pillars are densely formed toward the one end of the washing channel.

15. The fluid analysis chip as claimed in claim 9, wherein at least one washing part bent hole is configured to pass through the first substrate.

16. The fluid analysis chip as claimed in claim 15, wherein the washing part bent hole is formed in a center region in a width direction of the first substrate.

17. The fluid analysis chip as claimed in claim 16, wherein the washing part bent hole is formed with a size not to be clogged when the first substrate and the second substrate are assembled to each other.

* * * * *